US008805260B2

(12) United States Patent
Shimosugi

(10) Patent No.: US 8,805,260 B2
(45) Date of Patent: Aug. 12, 2014

(54) FIXING DEVICE, IMAGE FORMATION APPARATUS, AND METHOD OF MANUFACTURING FIXING ROLLER

(71) Applicant: Oki Data Corporation, Tokyo (JP)

(72) Inventor: Masahiko Shimosugi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 93 days.

(21) Appl. No.: 13/622,032

(22) Filed: Sep. 18, 2012

(65) Prior Publication Data

US 2013/0078020 A1 Mar. 28, 2013

(30) Foreign Application Priority Data

Sep. 26, 2011 (JP) ..... 2011-209251

(51) Int. Cl.
*G03G 15/20* (2006.01)

(52) U.S. Cl.
USPC ..... 399/333; 399/330; 430/124.32

(58) Field of Classification Search
USPC ..... 399/333, 330; 219/216, 469; 29/895, 29/895.32; 492/46; 430/124.3, 124.31, 430/124.32
See application file for complete search history.

(56) References Cited

U.S. PATENT DOCUMENTS

| | | | | | |
|---|---|---|---|---|---|
| 4,040,162 | A | * | 8/1977 | Isogai et al. | 29/403.2 |
| 5,609,624 | A | * | 3/1997 | Kalis | 623/1.32 |
| 2004/0247352 | A1 | | 12/2004 | Oishi et al. | |
| 2005/0169679 | A1 | * | 8/2005 | Uchiyama et al. | |

FOREIGN PATENT DOCUMENTS

| | | | | |
|---|---|---|---|---|
| JP | 04-072493 | A | * | 3/1992 |
| JP | 11-149226 | A | * | 6/1999 |
| JP | 2000-029342 | A | * | 1/2000 |
| JP | 2004-361839 | A | | 12/2004 |

* cited by examiner

*Primary Examiner* — Sophia S Chen
(74) *Attorney, Agent, or Firm* — Marvin A. Motsenbocker; Mots Law, PLLC

(57) ABSTRACT

A fixing device includes a fixing roller configured to be heated by a heat source, and a pressure roller configured to be in pressure-contact with the fixing roller. The fixing roller includes a cylindrical tubular core having an inner circumferential surface and one or more ribs protruded from the inner circumferential surface and extending spirally along the inner circumferential surface. The total number of times that the one or more spiral ribs cross through a region of contact between the fixing roller and the pressure roller is more than one, regardless of a rotation angle of the fixing roller.

10 Claims, 15 Drawing Sheets

FIXING DEVICE, IMAGE FORMATION APPARATUS, AND METHOD OF MANUFACTURING FIXING ROLLER

CROSS REFERENCE TO RELATED APPLICATIONS

This application claims priority based on 35 USC 119 from prior Japanese Patent Application No. 2011-209251 filed on Sep. 26, 2011, entitled "FIXING DEVICE, IMAGE FORMATION APPARATUS, AND METHOD OF MANUFACTURING FIXING ROLLER", the entire contents of which are incorporated herein by reference.

BACKGROUND OF THE INVENTION

1. Field of the Invention

This disclosure relates to an image formation apparatus such as an electrophotographic printer, a copying machine, or a facsimile. The invention particularly relates to a fixing device mounted on the image formation apparatus and configured to fix a toner image formed on a recording medium, and to a method of manufacturing a fixing roller to be mounted on the fixing device.

2. Description of Related Art

A conventional electrophotographic image formation apparatus widely uses a thermal roll type fixing device. The thermal roll type fixing device includes a fixing roller and a pressure roller and is configured to thermally fuse and fix a toner image attached on a recording sheet while transporting the recording sheet between the heated fixing roller and the pressure roller in pressure-contact with each other. The majority of the thermal roll type fixing devices have a halogen lamp or the like as a fixing heater, inside the fixing roller, to heat the fixing roller. The fixing device having the above configuration may employ a method of reducing the thermal capacity of the fixing roller by making a core of the fixing roller thinner in order to shorten the warm-up time to heat the fixing roller from room temperature to a given temperature required for a fixing process (for example, see FIG. 1, paragraph 0021 of Patent Literature 1: Japanese Patent Application Publication No. 2004-361839).

SUMMARY OF THE INVENTION

However, the conventional fixing device equipped with a fixing roller having a thinner core has weak mechanical strength that may cause the following problems. Specifically, the fixing roller is bent in an arch shape at a nip portion where the roller is in contact with the pressure roller, and thus produces only weak contact pressure at its central portion such that the nip force is reduced to deteriorate the fixing performance. Further, the fixing roller sways due to the deformation of the roller, thus deteriorating the fixing performance and making the sheet more likely to skew or crease.

A first aspect of the invention is a fixing device including: a fixing roller configured to be heated by a heat source; and a pressure roller configured to be in pressure-contact with the fixing roller. The fixing roller includes a cylindrical tubular core having an inner circumferential surface and one or more ribs protruding from the inner circumferential surface and extending spirally along the inner circumferential surface. The total number of times that the one or more spiral ribs cross through a region of contact between the fixing roller and the pressure roller is more than one, regardless of a rotation angle of the fixing roller.

A second aspect of the invention is a method of manufacturing a fixing roller including a cylindrical tubular core. The method includes: extruding a heated ingot billet made of an aluminum alloy through an opening of a die having a cross-sectional shape substantially equivalent to a cross-sectional shape of the cylindrical tubular core, and thereby forming an extruded original pipe; and drawing the extruded original pipe through a gap between an outer-diameter tool and an inner-diameter tool which define the cross-sectional shape of the cylindrical tubular core, thereby obtaining the cylindrical tubular core with the cross-sectional shape. In the drawing step, the original pipe is drawn while being rotated to obtain the cylindrical tubular core having a spiral rib formed on an inner circumferential surface of the cylindrical tubular core.

The above aspect(s) allows a cylindrical tubular core to be made thinner while keeping enough strength of the tubular core. Accordingly, this may contribute to the shortening of the warm-up time of a fixing roller.

DETAILED DESCRIPTION OF EMBODIMENTS

Figure 1:
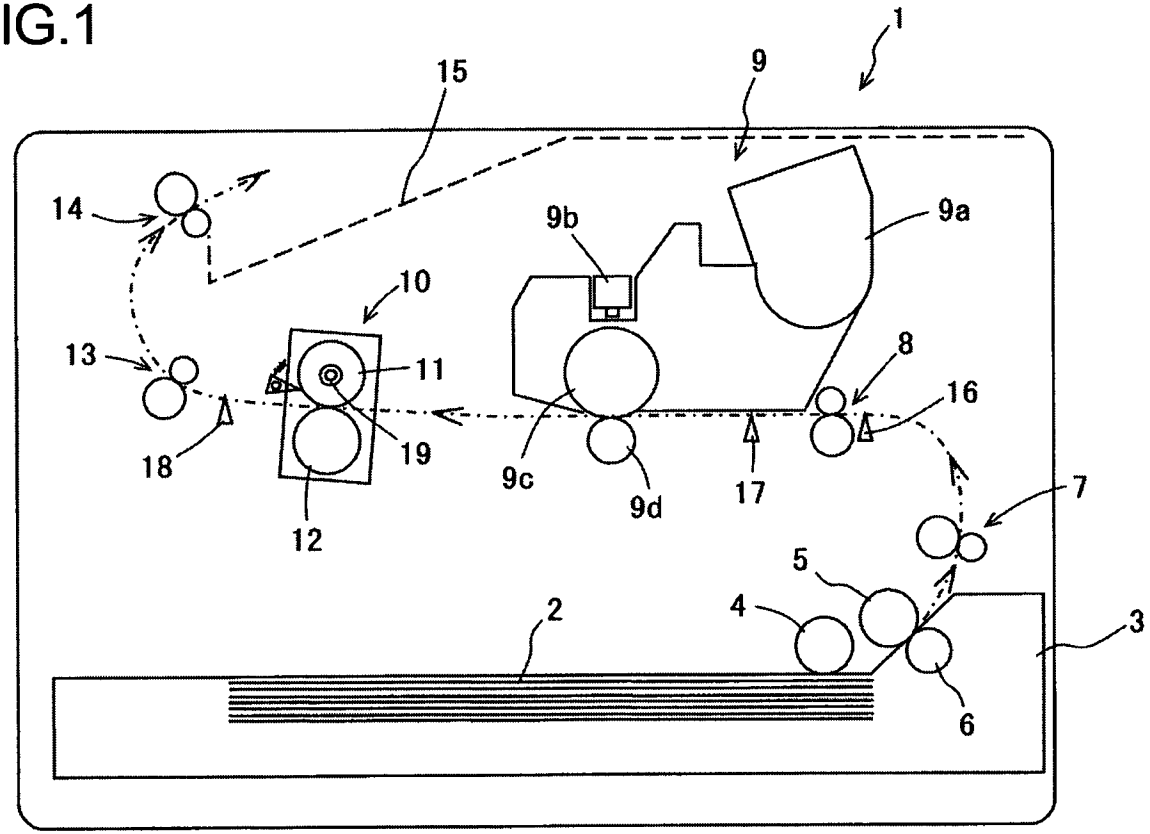
FIG. 1 is a configuration diagram illustrating a configuration of a part of a printer including a fixing device according to a first embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

First Embodiment

FIG. 1 is a configuration diagram illustrating a configuration of a part of a printer of a first embodiment equipped with a fixing device according to the invention.

As shown in FIG. 1, paper feed cassette 3 is detachably attached in a lower part of printer 1 as an image formation apparatus. Paper feed cassette 3 is configured to house stacked recording sheets 2 as recording media inside. Pickup roller 4 is placed in an upper part of a portion of paper feed cassette 3 from which recording sheets 2 are taken out, at a position in contact with stacked sheets 2. In the vicinity of pickup roller 4, paper feed roller 5 and retard roller 6 are placed to face each other. Paper feed roller 5 and retard roller 6 are configured to feed recording sheet 2, which is fed from paper feed cassette 3 by pickup roller 4, upward (toward a downstream side in a sheet transport direction) one at a time. In FIG. 1, a transport path and transport direction of recording sheet 2 being transported are shown by the dashed line and arrow, respectively.

Recording sheet 2 thus fed by paper feed roller 5 and retard roller 6 one at a time is sent to image formation unit 9 by paired transport rollers 7 and 8 placed along the transport path.

Image formation unit 9 includes toner cartridge 9*a*, recording head 9*b*, photosensitive drum 9*c*, transfer roller 9*d*, and the like. Image formation unit 9 is configured to form a toner image according to recording data and to transfer the toner image on recording sheet 2 transported to image formation unit 9. Fixing device 10 is placed downstream of image formation unit 9 in the transport direction. Fixing device 10 is configured to fix the toner image, which is transferred to recording sheet 2, on recording sheet 2 by thermal fusing. Fixing device 10 includes fixing roller 11, pressure roller 12 in pressure-contact with fixing roller 11, and halogen lamp 19 as a heat source placed inside the fixing roller.

Paired transfer rollers 13 and paired transfer rollers 14 are provided in this order along the transport path at a downstream side of fixing device 10 in the transport direction. Paired transfer rollers 13 and paired transfer rollers 14 are configured to eject recording sheet 2, which has the toner image fixed thereon and is ejected from fixing device 10, to paper ejection tray 15 placed in an upper part of printer 1. Printed recording sheets 2 are sequentially stacked on this paper ejection tray 15. Sensors 16, 17, and 18 are provided to detect where recording sheet 2 being transported is currently located. Sensor 16 is placed right before paired transport rollers 8, sensor 17 is placed between paired transport rollers 8 and transfer roller 9*d*, and sensor 18 is placed between fixing device 10 and paired transport rollers 13.

Note that pickup roller 4, paper feed roller 5, retard roller 6, paired transport rollers 7, 8, 13, and 14, and photosensitive drum 9*c* are driven to rotate by an unillustrated driving unit.

Figure 2:
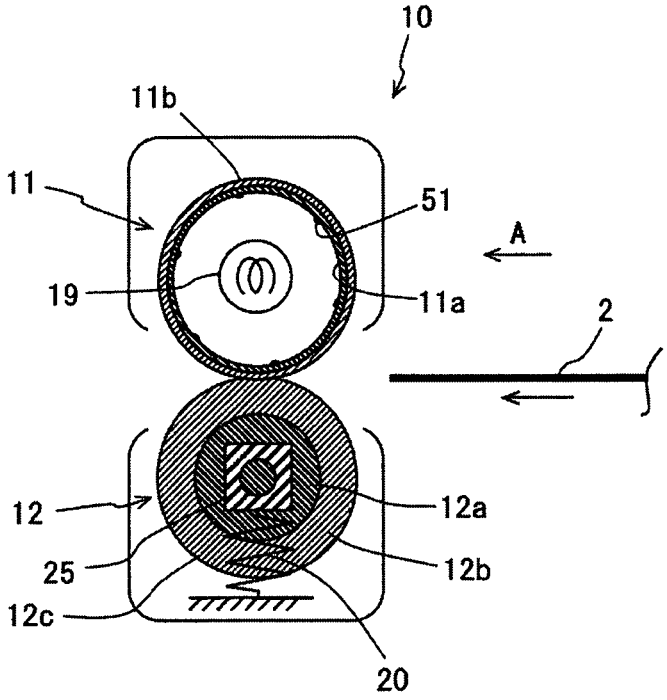
FIG. 2 is a main-part cross-sectional view illustrating an internal configuration of the fixing device of the first embodiment.
Figure 3:
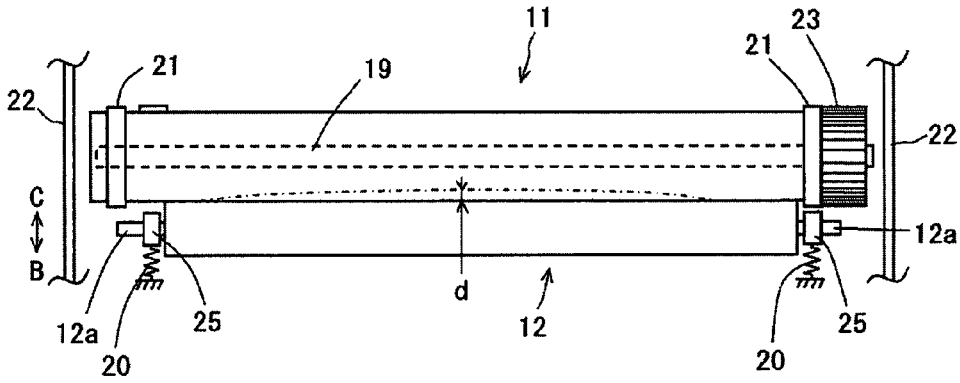
FIG. 3 is a main-part front view of the fixing device of the first embodiment as seen from an upstream side in a transport direction of a recording sheet (a direction indicated by the arrow A in FIG. 2).

FIG. 2 is a main-part cross-sectional view illustrating the internal configuration of fixing device 10. FIG. 3 is a main-part front view of fixing device 10 as seen from an upstream side in the transport direction of the recording sheet (i.e., a direction indicated by the arrow A in FIG. 2).

In FIGS. 2 and 3, fixing roller 11 includes cylindrical tubular core 11*a* and releasing layer 11*b* covering the outer circumferential surface of cylindrical tubular core 11*a*. Cylindrical tubular core 11*a* is made of aluminum with a thickness of 0.4 mm. As described later, cylindrical tubular core 11*a* has ribs 51 (see FIG. 4) which are protrusions protruded from an inner circumferential surface of cylindrical tubular core 11*a* and extending spirally about (around) the axis of cylindrical tubular core 11*a* along the inner circumferential surface. Releasing layer 11*b* is made of a fluorine resin such as PFA (perfluoroalkoxy) or PTFE (polytetrafluoroethylene), and has a thickness of 20 μm. Cylindrical tubular core 11*a* has two end portions in its axial direction rotatably held on side plates 22 (FIG. 3) by paired rotary bearings 21, 21 fixed on side plates 22, respectively. Further, fixing roller 11 has fixing gear 23 placed at one end of cylindrical tubular core 11*a* in the axial direction. Fixing roller 11 is rotated by power given from an unillustrated driving system to fixing gear 23 through driving gear 24 (see FIG. 12).

Pressure roller 12 includes: cylindrical columnar core 12*a* made of iron and having an outer diameter of 12 mm; elastic layer 12*b* configured to cover columnar core 12*a* and made of a silicone rubber with a high heat-resistant property, a JIS-A hardness of about 16°, and a thickness of about 8.0 mm; and releasing layer 12*c* configured to cover the elastic layer, made of a fluorine resin such as PFA (perfluoroalkoxy) or PTFE (polytetrafluoroethylene), and having a thickness of 30 μm.

Columnar core 12*a* has small-diameter axis portions at two end portions in its axial direction. The axis portions are rotatably held by respective paired rotary bearings 25, 25. Paired rotary bearings 25, 25 are held by respective side plates 22 to be slidable in directions closer to and away from fixing roller 11, i.e., in directions indicated by the arrows B and C. Further, paired rotary bearings 25, 25 are biased by bias members 20, 20, such as springs, in the direction closer to fixing roller 11. In other words, pressure roller 12 is configured to be in pressure-contact with fixing roller 11 with a given pressure. At the center (the axis) of the inside of cylindrical tubular core 11*a* of fixing roller 11, halogen lamp 19 serving as the heat source for fixing roller 11 is placed to extend in the axial direction of fixing roller 11.

Figure 4:
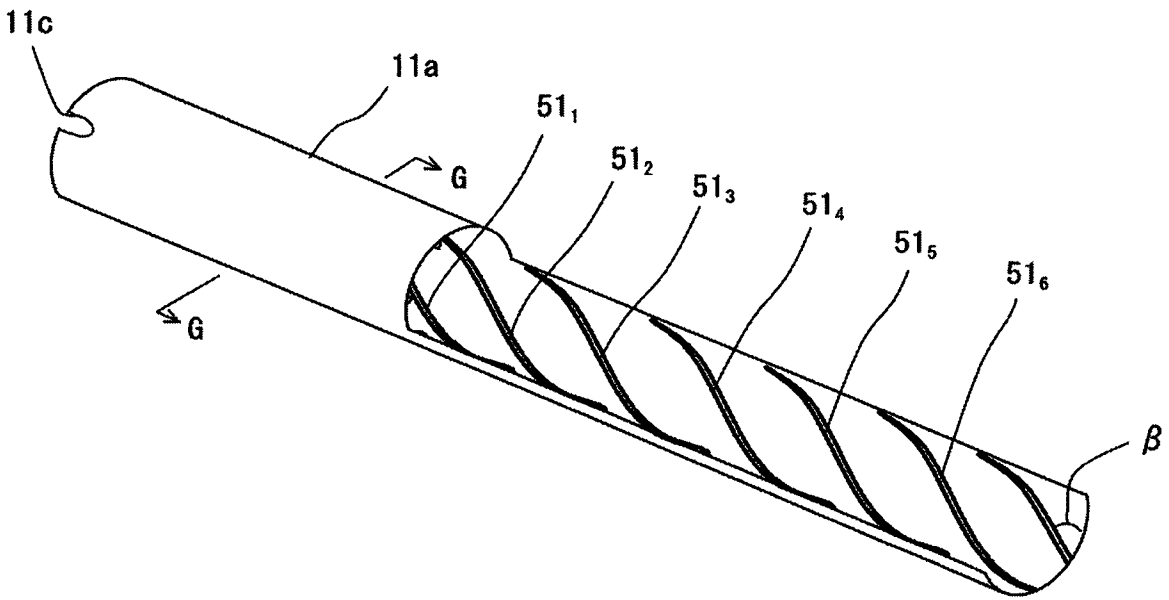
FIG. 4 is an exterior perspective view of a cylindrical tubular core of the first embodiment, illustrating a part of the cylindrical tubular core with its circumferential portion partially cut away to observe the inside of the cylindrical tubular core.
Figure 5A:
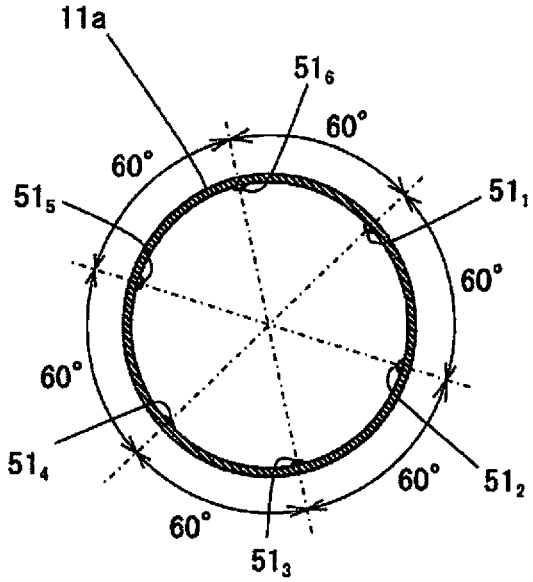
FIG. 5A is a cross-sectional view of the cylindrical tubular core taken along the line G-G of FIG. 4.
Figure 5B:
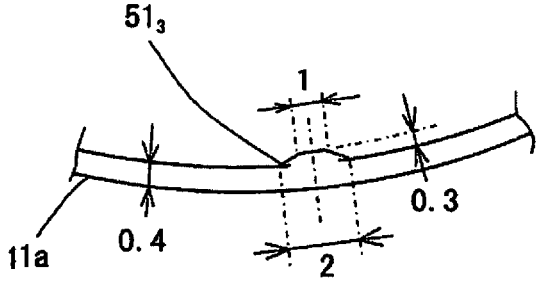
FIG. 5B is a partially enlarged view of FIG. 5A.

A further description is given of cylindrical tubular core 11*a* of fixing roller 11. FIG. 4 is an exterior perspective view illustrating cylindrical tubular core 11*a* while partially cutting away its circumferential portion to observe the inside of cylindrical tubular core 11*a*. FIG. 5A is a cross-sectional view of cylindrical tubular core 11*a* taken along the line perpendicular to the axis of cylindrical tubular core 11*a*, i.e., is a cross-sectional view taken along the line G-G of FIG. 4. FIG. 5B is a partially enlarged view of FIG. 5A.

As shown in FIGS. 4 and 5, six spiral ribs $\mathbf{51}_1$ to $\mathbf{51}_6$ (sometimes simply called ribs 51 when they do not particularly have to be distinguished from one another) are formed on the inner circumferential surface of cylindrical tubular core 11*a* at uniform intervals to divide the inner circumference of cylindrical tubular core 11*a* into six portions or segments. As shown in FIG. 5B, each rib 51 has a trapezoidal cross section with a lower edge of 2 mm, an upper edge of 1 mm, and a height of 0.3 mm. Moreover, the spiral of rib 51 has a lead angle β (see FIG. 4) of 60° in this embodiment. Further, as shown in FIG. 4, U-shaped groove 11*c*, configured to engage with fixing gear 23 (see FIG. 2) which is attached to cylindrical tubular core 11*a*, is formed at one end portion of cylindrical tubular core 11*a* in the axial direction, as described later.

Note that the lead angle 13 mentioned here denotes an angle between rib 51 and a plane extending orthogonal to the axial direction of cylindrical tubular core 11*a*.

Next, a description is given of a method of manufacturing fixing roller 11.

In this embodiment, fixing roller 11 is manufactured by carrying out, in the written order, the steps of: forming cylindrical tubular core 11*a*; machining two end portions of cylindrical tubular core 11*a* in the axial direction into shapes corresponding to the rotary bearings and the fixing gear; coating the inner surface of cylindrical tubular core 11*a* with a black powder coating material or the like for the purpose of enhancing the effect of heat-absorption from the heat source; roughening the outer circumferential surface of cylindrical tubular core 11*a* by sandblasting or the like; forming releasing layer 11*b* by, for example, coating a powder coating material made of a fluorine resin or the like; and polishing the surface of the roller.

Among these steps, in the step of forming cylindrical tubular core 11*a*, an extrusion step and a drawing step are first executed in this order to form a roller original pipe. The extrusion step is a hot working process, in which a columnar ingot billet, made of an aluminum alloy such as A5052 and heated to a temperature of 400° to 500°, is loaded into a container, and then pushed through the opening of a die having an approximate cross-sectional shape (including approximate cross-sectional shapes of ribs 51) of cylindrical tubular core 11*a*. In the drawing step, an original pipe thus formed by the extrusion (called "extruded original pipe" below) is drawn through the gap between a precise outer-diameter tool (a die) and an inner-diameter tool (a plug having the cross-sectional shapes of ribs 51 as well) at room temperature to obtain the roller original pipe with a precise cross-sectional shape. Subsequently, the bending of the roller original pipe thus formed is corrected by a roll corrector and then the corrected pipe is cut into pieces of any desired length, whereby the cylindrical tubular cores are formed.

In this embodiment, in the drawing step, the original pipe is drawn while being rotated at a constant speed. Thereby the corrected pipe is formed including the shape of the die, which is machined to have the cross-sectional shapes of the ribs, spirally extending along the inner circumferential surface of the corrected pipe. In the case where the inner diameter of the cylindrical tubular core is set at 28 mm, the drawing speed is set at 150 mm/sec, and the angular velocity of rotation is set at 354°/sec, the ribs are formed to have a lead angle β (see FIG. 4) of 60°.

Hereinbelow, a description is given of a result of a comparison experiment between printing using fixing device 10 including cylindrical tubular core 11*a* having ribs 51 formed on its inner circumferential surface, and printing using a fixing device including a cylindrical tubular core without ribs.

For example, if fixing device 10 shown in FIGS. 2 and 3 is equipped with a fixing roller having a cylindrical tubular core of 0.4 mm thickness without ribs 51, a deflection d (displacement at an axial middle region of a lower surface of the fixing roller shown by the dash-dot-dash line in FIG. 3) occurs when the fixing roller is brought into pressure-contact with pressure roller 12. This causes problems such as deterioration of the fixing performance, skew or crease of a sheet, and jitter in a recording image. In order to keep the deflection d within a negligible range in such a fixing roller having the cylindrical tubular core in the form of a plain cylinder, the cylindrical tubular core needs to have a thickness of about 0.8 mm. Note that the pressure-contact force applied by pressure roller 12 at this time is set at such a level that fixing roller 11 of this embodiment can perform a normal fixing process without being deformed.

In the meantime, an experiment is conducted while a fixing roller, having a cylindrical tubular core with a thickness of 0.8 mm and in the form of a plain cylinder, is mounted on the heater-embedded fixing device having the configuration shown in FIGS. 2 and 3. As a result, a warm-up time of about 15 seconds is needed for the surface of the roller to be heated from room temperature to 170°, which is the temperature required for the fixing process. Here, the roller is made of aluminum and has an outer diameter of 28 mm; and a power of 850 W is inputted to halogen lamp 19 in this experiment. On the other hand, in the case of fixing device 10 having the configuration shown in FIGS. 2 and 3 and equipped with fixing roller 11 of this embodiment, the warm-up time obtained by measurement under the same condition as above is about 10 seconds.

Evaluation of printing performance is conducted on printer 1 employing fixing device 10 equipped with the fixing roller having the cylindrical tubular core with a thickness of 0.8 mm and in the form of a plain cylinder or fixing roller 11 of this embodiment. As a result, no problem such as deterioration of the fixing performance, skew or crease of a sheet, or jitter in a recording image is caused. This shows that the deflection and compression deformation of these fixing rollers are kept within a negligible range.

In order for the fixing roller to achieve enough strength to prevent deformation of the fixing roller and enable normal fixing while cylindrical tubular core 11*a* is set, for example, as thin as 0.4 mm employed in this embodiment, it is preferable that, regardless of how many ribs 51 cylindrical tubular core 11*a* may have, and regardless of which rotation angle cylindrical tubular core 51 (the fixing roller) is positioned at, the total number of times that ribs 51 cross a region contact between fixing roller 11 and pressure roller 12 are more than one. The contact region extends in the axial direction between fixing roller 11 and pressure roller 12. In other words, regardless of the number of ribs 51 and regardless of the rotation angle of fixing roller 11, the protrusions constituting ribs 51 exist more than one in the contact region. This allows at least one rib to always exist in an axial middle region, which is a region near the center of the fixing roller in the axial direction, where deflection was likely to occur. The axial middle region is, for example, within a distance of one-quarter of the entire length of the fixing roller from the center of the roller in the axial direction. The rib(s) thus help the fixing roller to maintain enough strength.

In order to make more than one protrusions constituting ribs 51 exist in the contact region between fixing roller 11 and pressure roller 12 regardless of the rotation angle of fixing roller 11, the following formulae should be satisfied:

$$\tan(\beta max)=(w/2)/(\pi d/n) \quad (1)$$

and $$(\beta max)=\tan^{-1}((w/2)/(\pi d/n)) \quad (2),$$

where d[mm] is an inner diameter of the cylindrical tubular core, n is the number of ribs, w [mm] is a width of the portion of contact between the rollers, and βmax [rad] is the maximum lead angle of the rib. For example, the maximum lead angle of the rib βmax is 1.43 rad=82° when d=28 mm, n=6, and w=210 mm.

It should be noted that the required pressing force of the pressure roller against the fixing roller differs depending on the printing speed or the temperature characteristics of the toner. Accordingly, the final determination of the lead angle, the number of ribs, the shape of the rib, and the like is preferably made in consideration of a safety rate. The safety rate is obtained by checking, through mechanical strength analysis using the finite element method and the like, the amount of deflection of the fixing roller and checking the strength, such as stress, of portions of the fixing roller under practical use conditions. The practical use conditions are determined based on the mechanical property of a material of the fixing roller to be used. The fixing performance is also checked through an experiment and checking to see if the rollers create no crease on a sheet when letting the sheet pass therethrough.

As described above, according to the fixing device of this embodiment, the spiral ribs are provided on the inner circumferential surface of cylindrical tubular core 11*a* of fixing roller 11. Thereby, the fixing roller can be made thinner while keeping the required strength. This enables a shortening of the warm-up time needed for the fixing roller to reach a required temperature. Further, no additional step is needed to make the ribs since the ribs are formed at the same time when the body of the cylindrical tubular core 11*a* is formed.

Second Embodiment

Figure 6:
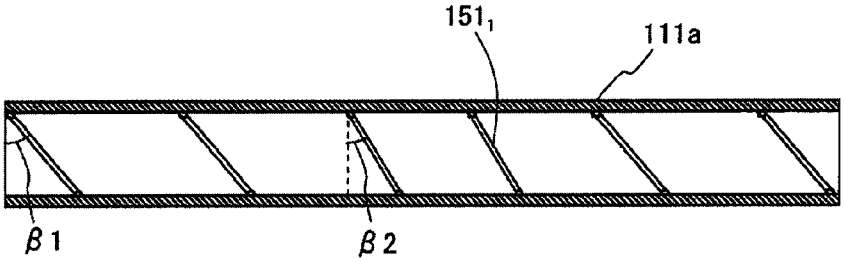
FIG. 6 is a cross-sectional view of a cylindrical tubular core according to a second embodiment of the invention taken along a plane extending in an axial direction, which shows the shape of the inside of the cylindrical tubular core.

FIG. 6 is a cross-sectional view taken along a plane extending in the axial direction, which shows the shape of the inside of cylindrical tubular core 111*a* according to a second embodiment of the invention. Note that, among six ribs 151 originally formed, only one rib $\mathbf{151}_1$ is shown in FIG. 5 to facilitate the description.

An image formation apparatus employing cylindrical tubular core 111*a* mainly differs from that employing cylindrical tubular core 11*a* of the first embodiment shown in, for example, FIG. 4 in the lead angle β of rib 151 formed in the inner circumferential surface, and the thickness of the cylindrical tubular core only. Accordingly, parts of the image formation apparatus employing this cylindrical tubular core 111*a* which differ from those of printer 1 (FIG. 1) of the first embodiment are mainly described while parts thereof identical to those of printer 1 are given the same reference numerals and are not illustrated nor described. Note that FIGS. 1 and 2 are also used for description as needed since the main configuration of the image formation apparatus of this embodiment is the same as the main configuration of printer 1 of the first embodiment shown in FIG. 1, except for cylindrical tubular core 111*a*.

The shape of the cross-section of cylindrical tubular core 111*a* perpendicular to the axial direction is the same as that of cylindrical tubular core 11*a* shown in FIG. 5 of the first embodiment except that cylindrical tubular core 111*a* is formed to have a thickness of 0.3 mm (0.4 mmm in the case of cylindrical tubular core 11*a* of the first embodiment) except for portions where ribs 151 are located.

As shown in FIG. 6, cylindrical tubular core 111*a* has such a configuration that a lead angle β2 at an axial middle region of cylindrical tubular core 111*a* is set smaller than a lead angle β1 at each axial end region of cylindrical tubular core 111*a*, i.e., that the density of ribs at the axial middle region of cylindrical tubular core 111*a* is set higher than the density of ribs at each end portion of cylindrical tubular core 111*a* in the axial direction.

The step of forming cylindrical tubular core 111*a* is the same as the step of forming cylindrical tubular core 11*a* described in the first embodiment except that an extruded original pipe is drawn while its rotation speed is changed in the drawing step. Note that, in this embodiment, the extruded original pipe to be sent to the drawing step has a length of about 4,000 mm, and is cut into pieces of 300 mm length in the final step to form cylindrical tubular cores 111*a*.

Figure 7:
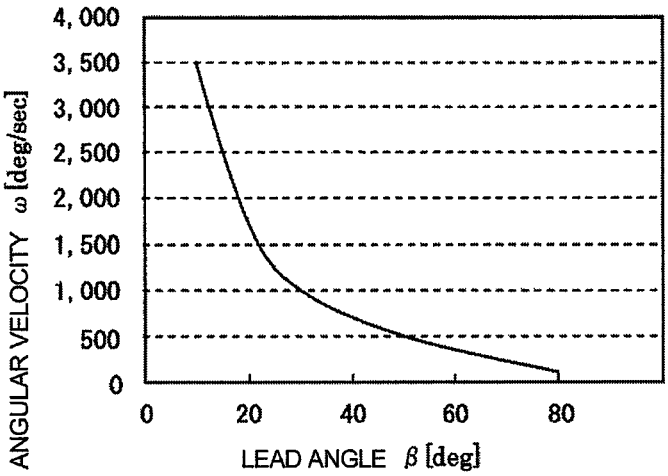
FIG. 7 is a graph illustrating a relation between the angular velocity of rotation ($\omega$) and the lead angle $\beta$ in the second embodiment.

FIG. 7 shows a relation between the angular velocity of rotation (ω) and the lead angle β observed when the drawing speed in the drawing step is set, for example, at 150 mm/sec (constant) and the angular velocity of rotation (ω) of a drawing jig (carriage) is changed. As shown in FIG. 7, the lead angle β can be changed by changing the angular velocity of rotation (ω) in the drawing step.

Figure 8:
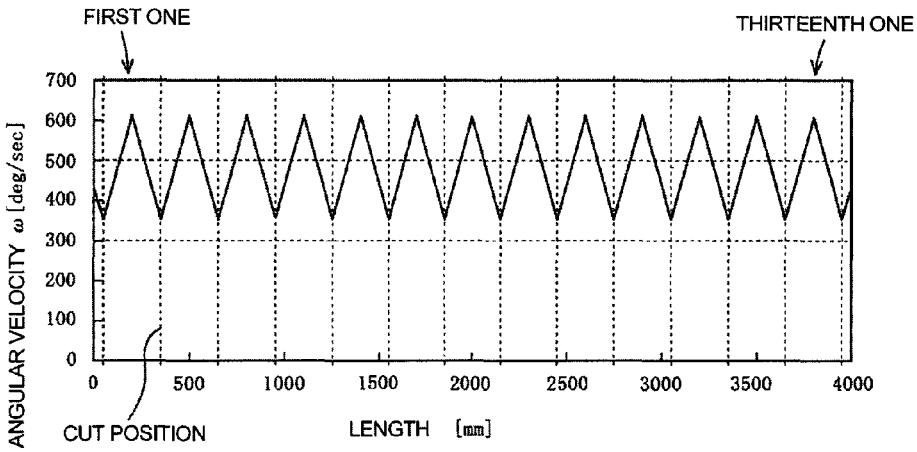
FIG. 8 is a graph illustrating a relation between the position of an extruded original pipe of 4,000 mm length (horizontal axis) and the angular velocity of rotation of a drawing jig (carriage) at each position (vertical axis) in the second embodiment.

Meanwhile, it is known that the deflection or compression of fixing roller 11 attributable to the nip load applied by pressure roller 12 is generally more likely to occur at an axial middle region of the roller than at each axial end region of the roller in fixing device 10 shown in FIGS. 2 and 3, and hence the strength at the axial middle region is preferably set larger than that at the axial end regions. Thus, in this embodiment, as shown in FIG. 8, while the extruded original pipe of 4,000 mm length is in the drawing step, the angular velocity of rotation (ω) is changed periodically and consecutively in each of the sections of the pipe corresponding to the respective first to thirteenth cylindrical tubular cores, in such a way that the angular velocity of rotation (ω) at the axial middle region is higher than that at each axial end region. Here, in the graph of FIG. 8, the horizontal axis indicates the position of the extruded original pipe of 4,000 mm length, and the vertical axis indicates the angular velocity of rotation (ω) of the drawing jig (carriage) at each position.

Figure 9:
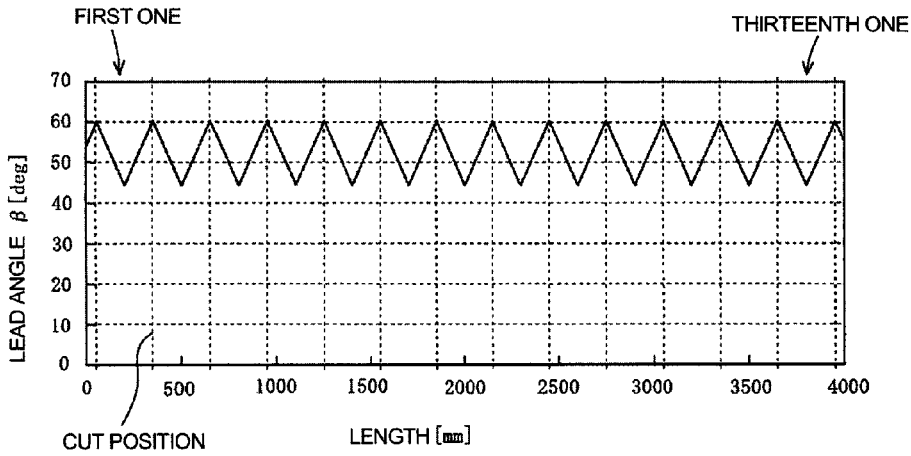
FIG. 9 is a graph illustrating a relation between the position of the extruded original pipe of 4,000 mm length (horizontal axis) and the lead angle $\beta$ at each position (vertical axis) in the second embodiment.

As shown in FIG. 9, the lead angle β of rib 151 formed on the inner circumferential surface of the pipe is changed in each of the sections of the pipe corresponding to the respective first to thirteenth cylindrical tubular cores in such a way that the lead angle β at the axial middle region is smaller than that at each axial end region. Here, in the graph of FIG. 9, the horizontal axis indicates the position of the extruded original pipe of 4,000 mm length, and the vertical axis indicates the lead angle β at each position.

Accordingly, thirteen cylindrical tubular cores 111*a* formed by cutting the extruded original pipe of 4,000 mm length subjected to the drawing step into pieces of predetermined length of cylindrical tubular core 111*a* (300 mm in this embodiment) each have the density of ribs at the axial middle region higher than at each axial end region. Here, in FIGS. 8 and 9, the dotted lines in the horizontal axis indicate cut positions.

Under the condition where the inner diameter of the core is set at 28 mm and the drawing speed is set at 150 mm/sec, for example, the lead angle of rib 151 at each end region of cylindrical tubular core 111*a* in the axial direction is 60° when the angular velocity of rotation (ω) at this position is 354°/sec; and the lead angle of rib 151 at the axial middle region of cylindrical tubular core 111*a* is 45° when the angular velocity of rotation (ω) at this position is 614°/sec.

Note that, although the description is given above of the example where the lead angle β is increased or decreased at a constant rate, the lead angle may be changed either stepwise or gradually as long as such change makes the density of ribs at the axial middle region higher than at each axial end region. FIG. 6 shows an example of cylindrical tubular core 111*a* whose lead angle β is changed stepwise (in two steps). Further, although the lead angle to be formed is adjusted by changing the angular velocity of rotation (ω) of the drawing jig (carriage) in the drawing step, the lead angle may be adjusted by increasing/decreasing the drawing speed with a constant angular velocity.

Hereinbelow, a description is given of a result of a printing experiment conducted using fixing device 10 equipped with cylindrical tubular core 111*a* having six ribs 151. Here, six ribs 151 are formed while the lead angle β is changed at a constant rate, i.e., in such a way that the lead angle at both axial end portions of rib 151 is 60° and the lead angle at a axial middle region of rib 151 is 45°. In this experiment, cylindrical tubular core 111*a* is made of aluminum and has an outer diameter of 28 mm.

When fixing roller 11, having cylindrical tubular core 111*a* of this embodiment, is mounted on heater-embedded fixing device 10 having the configuration shown in FIGS. 2 and 3, the warm-up time of about 8 seconds is needed for the surface of the roller to be heated to 170°. Here, a power of 850 W is inputted to halogen lamp 19 in this experiment.

Evaluation of the printing performance is conducted on printer 1 employing fixing device 10 equipped with fixing roller 11 having cylindrical tubular core 111*a*. As a result, no problem such as deterioration of the fixing performance, skew or crease of a sheet, or jitter in a recording image is caused. This shows that the deflection and compression deformation of the fixing roller are kept within a negligible range by increasing the density of ribs at the axial middle region. Note that the pressure-contact force applied by pressure roller 12 at this time is at such a level that fixing roller 11 of the first embodiment can perform a normal fixing process without being deformed.

As described above, according to the fixing device of this embodiment, the spiral ribs are formed on the inner circumferential surface of cylindrical tubular core 111*a* of fixing roller 11 in such a way that the density of ribs at the axial middle region of cylindrical tubular core 111*a* is higher than the density of ribs at each axial end region of cylindrical tubular core 111*a*, which enables an effective reinforcement by the ribs. This allows the fixing roller to have higher strength than that in the first embodiment even when the lead angle at each axial end region of the cylindrical tubular core is the same as that in the first embodiment for example. Thereby, the cylindrical tubular core can be made thinner than that in the first embodiment, which in turn makes it possible to further shorten the warm-up time needed for the fixing roller to reach the required temperature.

Third Embodiment

Figure 10:
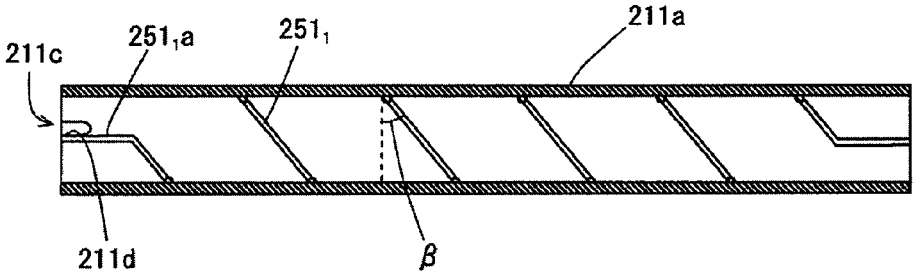
FIG. 10 is a cross-sectional view of a cylindrical tubular core according to a third embodiment of the invention taken along a plane extending in the axial direction, which shows the shape of the inside of the cylindrical tubular core.

FIG. 10 is a cross-sectional view taken along a plane extending in the axial direction, which shows the shape of the inside of cylindrical tubular core 211*a* according to a third embodiment of the invention. Note that, among six ribs 251 originally formed, only one rib $\mathbf{251}_1$ is shown in FIG. 10 to facilitate the description.

An image formation apparatus employing cylindrical tubular core 211*a* mainly differs from that employing cylindrical tubular core 11*a* of the first embodiment shown in, for example, FIG. 4 in the shape of rib 251 at both axial end regions of cylindrical tubular core 211*a*. Accordingly, parts of the image formation apparatus employing this cylindrical tubular core 211*a* which differ from those of printer 1 (FIG. 1) of the first embodiment are mainly described while parts thereof identical to those of printer 1 are given the same reference numerals and are not illustrated nor described. Note that FIGS. 1 and 2 are also used for description as needed since the main configuration of the image formation apparatus of this embodiment is the same as the main configuration of printer 1 of the first embodiment shown in FIG. 1 except for cylindrical tubular core 211*a*.

Six ribs 251 (among which only one rib $\mathbf{251}_1$ is shown in FIG. 10) formed on the inner circumferential surface of cylindrical tubular core 211*a* are each formed to have portions, which extend parallel with the axial direction, at both axial end regions of cylindrical tubular core 211*a*. In other words, six ribs 251 are each formed in such a way that both axial end regions of rib 251 each extend parallel with the axial direction of cylindrical tubular core 211*a*, whereas an axial middle region of rib 251 is formed spirally about the center (the axis) of cylindrical tubular core 211*a*. Further, as shown in FIG. 10, U-shaped groove 211*c* is formed along, for example, axial end portion $\mathbf{251}_1a$ of one rib $\mathbf{251}_1$ out of six ribs $\mathbf{251}_1$ to $\mathbf{251}_6$. More specifically, axial end portion $\mathbf{251}_1a$ of rib $\mathbf{251}_1$ is formed to extend along one sidewall surface 211*d* of U-shaped groove 211*c*. Note that paired sidewall surfaces of this U-shaped groove 211*c* are formed to extend parallel with the axial direction of cylindrical tubular core 211*a* and the shape of U-shaped groove 211*c* itself is the same as that of U-shaped groove 11*c* of the first embodiment. To put it differently, U-shaped groove 211*c* is defined by the paired sidewall surfaces parallel with the axial direction of the cylindrical tubular core and a connection surface curved in the form of the letter C and configured to connect one of the ends of the respective paired sidewall surfaces with each other.

Figure 11:
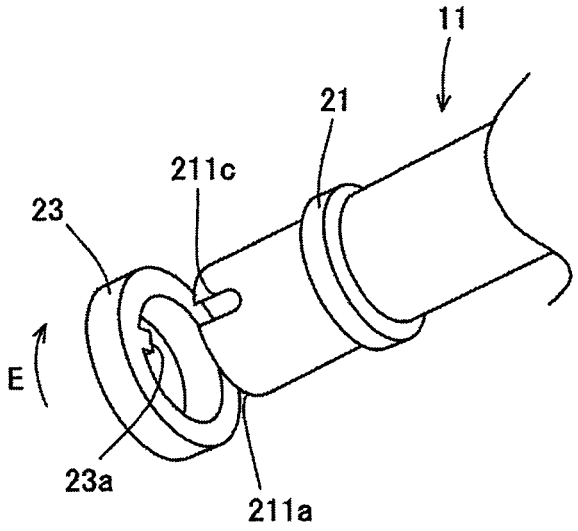
FIG. 11 is a perspective view illustrating a fixing roller having the cylindrical tubular core, a rotary bearing, and a fixing gear of the third embodiment as seen from obliquely below in order to describe how these components engage with each other.

FIG. 11 is a perspective view illustrating fixing roller 11 having cylindrical tubular core 211*a*, rotary bearing 21, and fixing gear 23 as seen from obliquely below in order to describe how these components engage with each other.

As described in FIG. 3, fixing roller 11 is rotatably held on side plates 22 by paired rotary bearings 21, 21 fixed on respective side plates 22, and fixing gear 23 is attached to one end of fixing roller 11. This fixing gear 23 is formed in a ring shape so that fixing roller 11 can be inserted thereinto. Fixing gear 23 has convex portion 23*a* formed in its inner circumferential portion to be inserted into, and engage with, U-shaped groove 211*c*.

Figure 12:
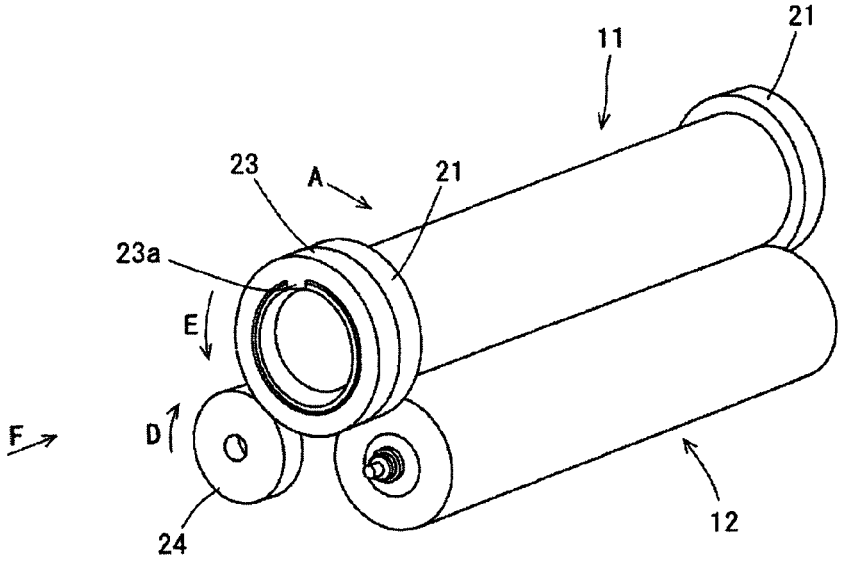
FIG. 12 is a view for describing operations and positional relations of the fixing roller loaded with the fixing gear, a pressure roller, and a driving gear when they are installed in the printer in the third embodiment.

FIG. 12 is a view for describing operations and positional relations of fixing roller 11 loaded with fixing gear 23, pressure roller 12, and driving gear 24 when they are installed in printer 1. When installed in printer 1, fixing roller 11 is rotatably held on fixing device 10 main body by paired rotary bearings 21, 21 while its axial movement is restricted by unillustrated restriction members attached to both axial end regions of fixing roller 11. Pressure roller 12 is configured to be in pressure-contact with fixing roller 11 with a given pressure, as described in FIGS. 2 and 3.

Driving gear 24 is rotatably placed in the fixing device to mesh with fixing gear 23. Upon transmission of rotation from an unillustrated fixing motor as a driving unit, driving gear 24 is rotated in a direction indicated by the arrow D to drive fixing roller 11 to rotate in a direction indicated by the arrow E. Here, the arrow A in FIG. 12 indicates a direction in which recording sheet 2 (see FIG. 2) having a toner image transferred thereon is carried.

Figure 13A:
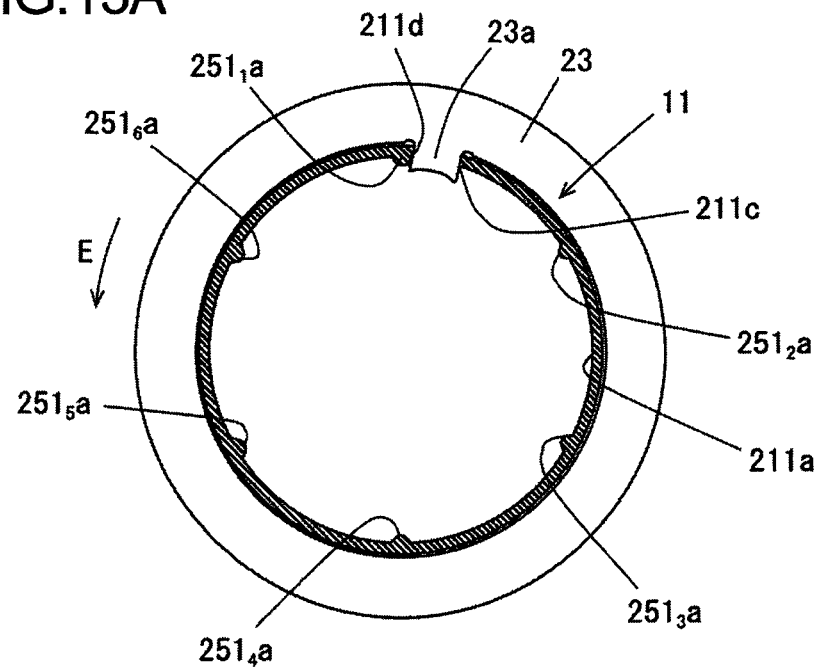
FIG. 13A is a front view illustrating the fixing gear and the fixing roller having the cylindrical tubular core in the third embodiment as seen in a direction indicated by the arrow F of FIG. 12.
Figure 13B:
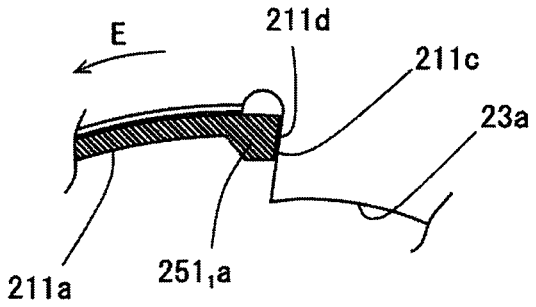
FIG. 13B is a partially enlarged view of an engagement portion between a convex portion of the fixing gear and a U-shaped groove of the cylindrical tubular core in FIG. 13A.

FIG. 13A is a front view illustrating fixing gear 23 and fixing roller 11 having cylindrical tubular core 211*a* as seen in a direction indicated by the arrow F of FIG. 12. FIG. 13B is a partially enlarged view of an engagement portion between convex portion 23*a* of fixing gear 23 and U-shaped groove 211*c* of cylindrical tubular core 211*a* in FIG. 13A.

As shown in FIG. 13, while fixing gear 23 is rotated in the direction indicated by the arrow E, convex portion 23*a* of fixing gear 23 presses one sidewall surface 211*d* of U-shaped groove 211*c* of cylindrical tubular core 211*a*. As described above, axial end portion $\mathbf{251}_1a$ of rib $\mathbf{251}_1$ extending parallel with the axial direction of tubular core 211*a* is formed to extend along sidewall surface 211*d*. In this way, end portion $\mathbf{251}_1a$ extending parallel with the axial direction is formed to extend along one sidewall surface 211*d* of U-shaped groove 211*c* of cylindrical tubular core 211*a* on which the rotational load is applied by convex portion 23*a* of fixing gear 23.

Figure 14:
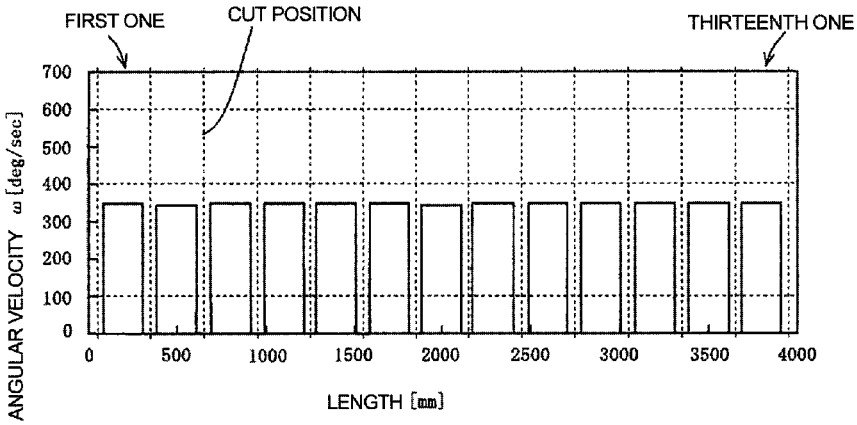
FIG. 14 is a graph illustrating a relation between the position of the extruded original pipe of 4,000 mm length (horizontal axis) and the angular velocity of rotation of the drawing jig (carriage) at each position (vertical axis) in the third embodiment.

A description is given here of a method of forming ribs 251. In this embodiment, while the extruded original pipe of 4,000 mm length is in the drawing step, in each of sections of the pipe corresponding to the respective first to thirteenth cylindrical tubular cores, the angular velocity of rotation (ω) at positions corresponding to both axial end regions of the cylindrical tubular core is changed to 0 (zero), as shown in FIG. 14. Here, in the graph of FIG. 14, the horizontal axis indicates the position of the extruded original pipe of 4,000 mm length, and the vertical axis indicates the angular velocity of rotation (ω) of the drawing jig (carriage) at each position.

Figure 15:
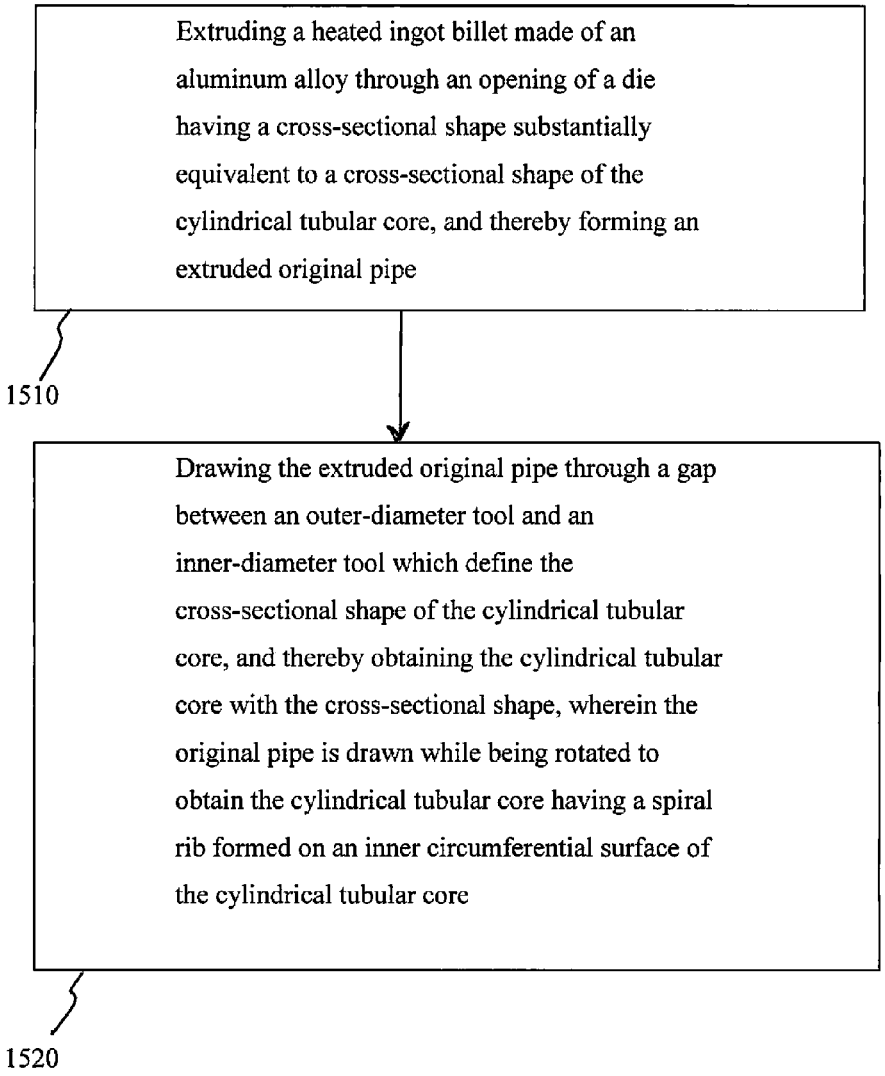
FIG. 15 shows the steps involved in manufacturing a fixing roller including a cylindrical tubular core according to an embodiment of the invention.

FIG. 15 shows the steps involved in manufacturing a fixing roller including a cylindrical tubular core according to an embodiment of the invention. The method includes a first step 1510 of extruding a heated ingot billet made of an aluminum alloy through an opening of a die having a cross-sectional shape substantially equivalent to a cross-sectional shape of the cylindrical tubular core, and thereby forming an extruded original pipe. The method also includes a second step 1520 of drawing the extruded original pipe through a gap between an outer-diameter tool and an inner-diameter tool which define the cross-sectional shape of the cylindrical tubular core, and thereby obtaining the cylindrical tubular core with the cross-sectional shape, wherein in the drawing step, the original pipe is drawn while being rotated to obtain the cylindrical tubular core having a spiral rib formed on an inner circumferential surface of the cylindrical tubular core.

As a result, in each of the sections of the pipe corresponding to the respective first to thirteenth cylindrical tubular cores, the lead angle β of rib 251 formed on the inner circumferential surface of the cylindrical tubular core is 90° at the positions corresponding to both of the axial end regions of the cylindrical tubular core. In other words, rib 251 extends parallel with the axial direction at both of the axial end regions of the cylindrical tubular core. In sum, cylindrical tubular cores 211*a* formed by cutting the extruded original pipe of 4,000 mm length subjected to the drawing step into pieces of predetermined length of cylindrical tubular core 211*a* (300 mm in this embodiment), each have end portion 251*a* of rib 251 extending in the axial direction of the cylindrical tubular core. In this embodiment, rib 251 in an axial middle region other than both axial end regions is formed to have the lead angle β of 60° by the setting such that the inner diameter of the core is 28 mm, the drawing speed is 150 mm/sec, and the angular velocity of rotation (ω) at the axial middle region is 354°/sec. Here, in FIG. 14, the dotted lines in the horizontal axis indicate cut positions.

Further, in this embodiment, U-shaped groove 211*c* described above is formed by machining both of the axial end regions of the cylindrical tubular core after the drawing step. In the step of machining this U-shaped groove 211*c*, U-shape groove 211*c* is formed in such a way that one sidewall surface 211*d* of U-shaped groove 211*c* on which the rotational load is applied by convex portion 23*a* of fixing gear 23 extends along end portion 251*a* (for example, $\mathbf{251}_1a$) of one of six ribs 251 (for example, $\mathbf{251}_1a$, or $\mathbf{251}_2a$ or $\mathbf{251}_3a$, or $\mathbf{251}_4a$ or $\mathbf{251}_5a$ or $\mathbf{251}_6a$).

As described above, when the unillustrated fixing motor is driven to rotate fixing gear 23 in the direction indicated by the arrow E in the fixing device having the above configuration, convex portion 23*a* of fixing gear 23 presses one sidewall surface 211*d* of U-shaped groove 211*c* of cylindrical tubular core 211*a*. However, end portion $\mathbf{251}_1a$ of rib $\mathbf{251}_1$ formed to extend along sidewall surface 211*d* enables expansion of a contact area between U-shaped groove 211*c* and convex portion 23*a* of fixing gear 23.

Meanwhile, if cylindrical tubular core 211*a* of fixing roller 11 is formed thin and end portion $\mathbf{251}_1a$ of rib $\mathbf{251}_1$ is not formed to extend along sidewall surface 211*d*, the contact area between U-shaped groove 211*c* and convex portion 23*a* of fixing gear 23 is so small that the load applied from fixing gear 23 to cylindrical tubular core 211*a* cannot be balanced enough. This may deform or damage the engagement portion between U-shaped groove 211*c* and convex portion 23*a* and reduce the durability of fixing roller 11 and fixing device 10. At the same time, the concentration of the shear force of fixing gear 23 on convex portion 23*a* may break convex portion 23*a*.

When fixing roller 11 having cylindrical tubular core 211*a* of this embodiment is mounted on heater-embedded fixing device 10 having the configuration shown in FIGS. 2 and 3, the warm-up time of about 10 seconds is needed for the surface of the roller to be heated to 170°. Here, a power of 850 W is inputted to halogen lamp 19 in this experiment.

Evaluation of the printing performance is conducted on printer 1 employing fixing device 10 equipped with fixing roller 11 having cylindrical tubular core 211*a*. As a result, no problem, such as deterioration of the fixing performance, skew or crease of a sheet, or jitter in a recording image, is caused. This shows that the deflection and compression deformation of the fixing roller are kept within a negligible range by increasing the density of ribs at the axial middle region. Note that the pressure-contact force applied by pressure roller 12 at this time is set at such a level that fixing roller 11 of the first embodiment can perform a normal fixing process without being deformed.

As described above, the fixing device of this embodiment can bring about the same effect as the fixing device of the first embodiment. Besides, the expansion of the contact area between U-shaped groove 211*c* of cylindrical tubular core 211*a* and convex portion 23*a* of fixing gear 23 enables balancing of the load applied from/on cylindrical tubular core 211*a* of the fixing roller on/from convex portion 23*a* of fixing gear 23, which in turn improves the durability of the fixing device.

It should be noted that, although the contact surface between convex portion 23*a* of fixing gear 23 and end portion $\mathbf{251}_1a$ of rib $\mathbf{251}_1$ of cylindrical tubular core 211*a* of fixing roller 11 is formed to extend in the axial direction of cylindrical tubular core 211*a* in the example described in this embodiment, the contact surface does not necessarily have to be formed to have the lead angle β of 90°, i.e., to extend parallel with the axis of the core. The same or similar effect can be achieved when a U-shaped groove and a convex portion of a fixing gear are formed to extend along a set lead angle, or when a U-shaped groove is formed to cross a part of the ribs.

Further, although the invention is applied to the heater-embedded fixing roller in each of the examples described in the above embodiments, the invention is not limited to such a heater-embedded fixing roller. Instead of the heater-embedded fixing roller, the invention can be applied to a fixing roller having a heater outside the roller, and to a direct heating fixing roller or induction heating fixing roller having a resistance heating layer on its circumferential surface. By providing spiral ribs according to the invention, a fixing roller of any heating system can improve its strength significantly. This makes it possible to make a fixing roller thinner and thereby to shorten the warm-up time of the fixing roller.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A fixing device comprising:

a fixing roller configured to be heated by a heat source; and a pressure roller configured to be in pressure-contact with the fixing roller, wherein the fixing roller includes a cylindrical tubular core having an inner circumferential surface and at least one spiral rib protruding from the inner circumferential surface and extending spirally along the inner circumferential surface, and the total number of times that the at least one spiral rib crosses through a region of contact between the fixing roller and the pressure roller is more than one, regardless of a rotation angle of the fixing roller, wherein the at least one spiral rib has a lead angle at an axial middle region of the fixing roller smaller than a lead angle at an axial end region of the fixing roller, wherein the lead angle is an angle of the at least one spiral rib with respect to a plane extending orthogonal to an axis of the cylindrical tubular core.

2. The fixing device according to claim 1, wherein the lead angle decreases monotonically from the axial end regions of the fixing roller toward an axial center of the fixing roller.

3. The fixing device according to claim 1, wherein the cylindrical tubular core is made of an aluminum alloy.

4. The fixing device according to claim 1, wherein the at least one spiral rib comprises more than one spiral ribs.

5. An image formation apparatus comprising a fixing device, the fixing device of claim 1.

6. A fixing device comprising:

a fixing roller configured to be heated by a heat source; and a pressure roller configured to be in pressure-contact with the fixing roller, wherein the fixing roller includes a cylindrical tubular core having an inner circumferential surface and at least one spiral rib protruding from the inner circumferential surface and extending spirally along the inner circumferential surface, the total number of times that the at least one spiral rib crosses through a region of contact between the fixing roller and the pressure roller is more than one, regardless of a rotation angle of the fixing roller, the cylindrical tubular core includes a U-shaped groove configured to engage with a gear configured to transmit a driving force, the U-shaped groove is defined by paired sidewall surfaces and a connection surface connecting the paired sidewall surfaces with each other, and one of the sidewall surfaces of the U-shaped groove extends along a part of the at least one rib.

7. An image formation apparatus comprising the fixing device of claim 6.

8. A method of manufacturing a fixing roller including a cylindrical tubular core, comprising:

extruding a heated ingot billet made of an aluminum alloy through an opening of a die having a cross-sectional shape substantially equivalent to a cross-sectional shape of the cylindrical tubular core, and thereby forming an extruded original pipe; and drawing the extruded original pipe through a gap between an outer-diameter tool and an inner-diameter tool which define the cross-sectional shape of the cylindrical tubular core, and thereby obtaining the cylindrical tubular core with the cross-sectional shape, wherein in the drawing step, the original pipe is drawn while being rotated to obtain the cylindrical tubular core having a spiral rib formed on an inner circumferential surface of the cylindrical tubular core, wherein the original pipe is drawn while being rotated with a varying rotation speed.

9. The method of manufacturing a fixing roller according to claim 8, wherein the rotation of the original pipe is temporarily stopped in the drawing step.

10. The method of manufacturing a fixing roller according to claim 8, wherein the drawing step is carried out at room temperature.

* * * * *